United States Patent [19]

Hawkins

[11] Patent Number: 4,857,148

[45] Date of Patent: Aug. 15, 1989

[54] STAPLE FIBER, FINISH THEREFOR AND PROCESS FOR USE OF SAME

[75] Inventor: Roland L. Hawkins, Spartanburg, S.C.

[73] Assignee: Hoechst Fibers Industries, Spartanburg, S.C.

[21] Appl. No.: 67,465

[22] Filed: Aug. 17, 1979

Related U.S. Application Data

[60] Continuation-in-part of Ser. No. 818,128, Jul. 22, 1977, abandoned, which is a division of Ser. No. 715,719, Aug. 19, 1976, Pat. No. 4,179,543.

[51] Int. Cl.[4] ..... D21F 11/00

[52] U.S. Cl. ..... 162/157.2; 162/158

[58] Field of Search ..... 162/157.2, 158

[56] References Cited

U.S. PATENT DOCUMENTS 4,007,083 2/1977 Ring ..... 427/385

*Primary Examiner*—Sam Silverberg

*Attorney, Agent, or Firm*—Dority & Manning

[57] ABSTRACT

A composition for short cut, synthetic polymeric staple fibers that are used in a wet lay application for the production of nonwovens is disclosed and claimed herein along with a fiber having the finish thereon and the process for dispersing the fiber in an aqueous medium. Synthetic polymeric filaments are cut into staple lengths, generally in a range of from about ¼ to about 3 inches in length, and are dispersed in an aqueous medium in conjunction with a composition that includes as an essential ingredient, an ethoxylated primary emulsifier that contains at least five moles of ethylene oxide, and exhibits a surface tension of at least 30 dynes per centimeter in a 0.10 weight percent aqueous solution at 25 degrees Centigrade plus or minus 2 degrees Centigrade. Optionally a lubricant may be added to the finish composition to improve processability of the fiber during manufacture. The lubricant should be compatible with the primary emulsifier. A secondary emulsifier may also be added to emulsify the lubricant, and may additionally assist in dispersing the fiber. The composition may be added to the fiber during the manufacture of same or may be added to the aqueous medium. A preferred composition for addition to the fiber at the time of manufacture includes 50 parts of an ethoxylated castor oil, 25 parts of an ethoxylated sorbitol hexoleate and 25 parts of n-octyl, n-decyl adipate. The composition should further be characterized by a low foaming propensity and as not adversely affecting bondability of the fibers.

5 Claims, No Drawings

STAPLE FIBER, FINISH THEREFOR AND PROCESS FOR USE OF SAME

CROSS REFERENCE TO RELATED APPLICATION

This application is a continuation-in-part of application Ser. No. 818,128, filed July 22, 1977 now abandoned, which is a division of Ser. No. 715,719, filed Aug. 19, 1976 now U.S. Pat. No. 4,179,543.

BACKGROUND OF THE INVENTION

In a wet lay process for the production of nonwoven webs, short cut staple fibers, either natural, synthetic, or a blend of same are dispersed in an aqueous medium to produce a fiber slurry. A chemical binder is added to the slurry or to the formed web to promote bonding of the fibers into a unified structure. The fiber slurry is fed to a paper making machine, such as a Fourdrinier machine where it is positioned on a porous support. Suction is applied beneath the porous support and removes the majority of the aqueous medium from the slurry, leaving a damp web of fibers across the forming area. The newly formed web is then further processed to yield a final nonwoven web where the fibers are bound to adjacent fibers to define a unitary structure.

A nonwoven web produced by the wet lay process can be only as good as the initial fiber dispersion. The fiber dispersion determines uniformity across the width of the web, the presence or the absence of voids in the web, later bondability of the fibers into a unitary structure, and the presence or absence of globs of fiber in the web. It is therefore quite important that a proper fiber dispersion be achieved to produce a good fiber slurry and thereafter, that the fiber slurry be properly processed to realize a quality nonwoven web.

Previously, various materials have been added to the fiber and/or the aqueous medium in which the fiber is dispersed to attempt to produce a good fiber dispersion. Several criteria are important to the formation of this fiber dispersion. For example, it is necessary to avoid substantial foaming in the aqueous bath. Foaming produces entrapped air in the slurry, which if carried through the nonwoven forming process will produce voids in the ultimately formed web. Likewise, should a group of fibers be present in the slurry formation, adhering to each other and not individually dispersing, clumped fibers will appear in the web as a glob or thickened portion which is visually apparent. Still further, as mentioned above, chemical binders are employed to promote the adherence of individual fibers to adjacent individual fibers and thus provide a unitary nonwoven structure. In forming the fiber slurry, care must be taken to avoid the introduction of any ingredient into the aqueous medium that tends to promote foaming, or to reduce the dispersibility of the fiber, or that will chemically or mechanically adverse affect the efficacy of the binder that is utilized. Also the composition should not interfere with other ingredients of the aqueous medium, such as viscosity builders, wetting agents, and the like.

The prior art is generally deficient in affording a proper fiber dispersion or slurry for the ultimate formation of the nonwoven web due to a deficiency in one or more of the above noted criteria. The present invention, however, overcomes shortcomings of the prior art, in that, a finish or dispersing composition is disclosed herein that permits the formation of a highly superior fiber dispersion that is low foaming, has virtually no fiber clumps and does not hinder finder bondability. The present composition thus leads to the ultimate formation of a uniform and high quality nonwoven web.

In general in a wet lay process, short cut staple fibers are provided to the nonwoven manufacturer. The nonwoven manufacturer, of course, has its own formulation for the white water into which the staple fibers are to be dispersed. Such formulations generally include surfactants, viscosity control agents and the like. Two particular systems are set forth in U.S. Pat. Nos. 4,007,803 to Ring et al and 4,049,491 to Brandon et al. Both Ring et al and Brandon et al disclose the addition of surfactants, e.g., alkylaryl polyether alcohol types (octyl phenol series) to achieve a white water surface tension of 30–35 dynes and emulsion stabilizers, e.g., natural or synthetic gums. The aqueous medium of the above noted patents is agitated to create tumbling water surface conditions in which up to, but less than about 4 percent by volume of air is entrained in the water in the form of tiny bubbles. The fibers are dispersed without excessive foam generations.

Short cut fibers of the present invention when utilized with a system of the type generally set forth in the above noted patents, affords an improved web from the standpoints of absence of voids, absence of clumps of fiber, and overall web uniformity. In like fashion, anionic surface active agents as disclosed herein afford similar advantage when on the staple fiber as a finish component or when added separately to the white water, or dispersing medium.

SUMMARY OF THE INVENTION

It is an object of the present invention to provide an improved finish composition for addition to a synthetic polymeric filament which will aid in the formation of a good fiber slurry after the filament has been cut into short fiber lengths and is added to an aqueous medium under slurry formation conditions.

It is another object of the present invention to provide an improved composition that may be added directly to an aqueous medium and assist a synthetic polymeric staple fiber in being properly dispersed in uniform fashion therein.

Still another object of the present invention is to provide an improved synthetic polymeric filament cut into staple fiber lengths for use in the production of nonwoven webs.

Yet another object of the present invention is to provide an improved process for the dispersion of short cut staple fibers in an aqueous medium.

Generally speaking, the finish composition according to the present invention is comprised of an ethoxylated primary emulsifier as an essential ingredient, said emulsifier containing at least five moles of ethylene oxide, and having a surface tension of at least 30 dynes per centimeter in a 0.10 weight percent solution at 25 degrees Centigrade plus or minus 2 degrees Centigrade, said composition being further characterized by a low foaming propensity and not adversely affecting fiber bondability.

More specifically, in certain situations the composition of the present invention may preferably include in addition to the primary emulsifier, a lubricant that assists in the processability of the fibers, particularly during cutting the filament into staple fiber lengths, the lubricant being compatible with the primary emulsifier and further, a secondary emulsifier the main purpose of which is emulsification of the lubricant and which is likewise compatible with the primary emulsifier. The lubricant and secondary emulsifier should not alter the foaming characteristics and should not decrease bondability of the fibers. Furthermore, other ingredients may be added to the composition so long as the requisite qualities of same are not adversely affected. For example, anionic constiuents, illustrated by potassium hexyl phosphate esters may be employed.

The anionic constituents may be applied to the fiber as a finish constituent, or alternatively may be aded to the aqueous medium in which the fibers are to be dispersed. In fact, at least certain of the class of anionic constituents, specifically identified hereinafter, will afford a proper fiber web when added to the aqueous dispersing medium, either in conjunction with, or in lieu of the type of surface active agents disclosed in the Ring et al and Brandon et al patents.

Preferably the anionic constituents are ethoxylated anionic surfactants or alcohol esters of phosphates, phosphonates, sulfates, or sulfonates having a chain length of at least about 12 carbon atoms, and with members of both groups exhibiting a surface tension of at least 30 dynes per centimeter when measured in a 0.10 weight percent solution at 25 degrees Centigrade plus or minus 2 degrees Centigrade.

Fibers for which the finish composition of the present invention is suitable include those synthetic polymeric filaments cut in staple fiber lengths to be used per se, or mixed with fibers of other types, including natural and synthetic fibers, in the production of a nonwoven web via a wet lay process. The fibers may have the finish composition applied thereto, or the composition may be applied to the aqueous medium in which the fibers are to be dispersed, being added in an amount approximately equivalent to that which would be applied to the fiber during manufacture.

The general process steps for dispersing fibers according to the present invention include manufacture of the fiber having the particular finish composition thereon, placing same in an aqueous medium and providing sufficient agitation to properly disrupt the fibers from any clump formation or general attachment to adjacent fibers and evenly disperse same throughout the aqueous medium. The fiber slurry so produced may thus be utilized to form a nonwoven web. Alternatively, the composition of the present invention and/or the specified anionic surfactants may be added to an aqueous medium in similar amounts such that the staple fibers without finish composition thereon or with other finish thereon may be added to the aqueous medium and dispersed in similar fashion.

Primary emulsifiers that are suitable for the composition of the present invention are ethoxylated organic compounds that contain at least five moles of ethylene oxide and exhibit a surface tension of at least 30 dynes per centimeter as defined herein, while not adversely affecting bondability of the fibers and having a low foaming propensity. Emulsifiers according to the above definition that are known to be suitable according to the teachings of the present invention include, without limitation, ethoxylated castor oils, ethoxylated hydrogenated castor oils, ethoxylated sorbitol esters, ethoxylated coconut oils, and the like. In a preferred embodiment the primary emulsifier has a polyoxyethylene chain containing from about five moles to about 40 moles of ehtylene oxide, and in a most preferred range, from about 10 to about 20 moles of ethylene oxide. This ingredient is essential to the present finish composition and is preferably present therein in an amount of at least 40 weight percent of same.

The lubricant that may be added to the finish composition is not per se critical to the dispersability of the fiber, but is preferably added to a composition that is to be applied to the fiber during manufacture to improve the processability of the fiber as mentioned above. The composition that is added to the fiber during manufacture may include a lubricant in a range of from about 0 to about 50 weight percent of the composition. Suitable lubricants to achieve good fiber processability include, without limitation, n-octyl n-decyl adipate, pentaerythritol tetrapelargonate, butyl stearate, tridecyl stearate, ethoxylated lauryl alcohol, coconut oil, ethoxylated lauric acid and mineral oil.

When a lubricant is utilized in the finish composition of the present invention, it is further preferred to add a secondary or auxiliary emulsifier, the main purpose of which is to emulsify the lubricant itself, though as a side benefit, the secondary emulsifier may further assist in dispersing the fiber in conjunction with the primary emulsifier. Normally when included, the secondary emulsifier is added in amounts up to 25 weight percent of the composition, though in a most preferred arrangement the amount of auxiliary emulsifier is no more than the amount of the lubricant, and the combination of lubricant and secondary emulsifier is no more than fifty percent of the composition. Suitable examples of secondary emulsifiers include, without limitation, ethylene-propylene oxide copolymers, ethoxylated lauryl alcohol, ethoxylated lauric acid, ethoxylated linear alcohols, e.g., $C_{12-18}$ alcohols, ethoxylated nonylphenol, ethoxylated sorbitol hexoleate, ethoxylated sorbitol laurate-oleate, ethoxylated sorbitan monostearate, and the like.

Anionic surfactants suitable for use according to the present invention are generally esters, and preferably esters of phosphates, phosphonates, sulfates, or sulfonates. Exemplary of suitable anionic constituents for addition to the finish composition include without limitation, the potassium salt of POE(6) decylalcohol phosphate; potassium octyl phosphonate; sodium tallow sarcosine; sodium lauryl sulfate; potassium oleate; the potassium salt of butyl carbitol phosphate; sulfonated glyceryl trioleate/peanut oil; the potassium salt of 2-ethylhexyl phosphate; sulfonated peanut oil; the potassium salt of dilauryl phosphate; sulfonated castor oil; the potassium salt of POE(7) $C_{13-15}$ alcohol phosphate blend, and 2-ethyl hexyl sulfosuccinate. The anionic constituent, for direct addition to the dispersion bath, is ethoxylated, or if not ethoxylated, has a chain length of at least about 12 carbon atoms with members of both clases exhibiting a surface tension of at least 30 dynes per centimeter as defined herein.

PREFERRED EMBODIMENTS OF THE PRESENT INVENTION

An overall process scheme for the production of a nonwoven web, utilizing a wet lay process, is generally set forth below. While a polyester fiber is employed in the discussion hereinafter, it should be understood that other fibers may likewise be employed such as polyacrylics, polyamides, polypropylene, and the like.

A filament forming polymeric composition suitable for the extrusion of polyester filaments is provided. Generically, this composition is the reaction product of a dicarboxylic acid, or ester-forming derivative of same and a glycol, such as dimethyl terephthalate and ethylene glycol, that is condensed to provide a polymer of the glycol ester of the dicarboxylic acid. The polymer is then extruded through a spinnerette under proper operating conditions into a plurality of continuous filaments that form a tow. After extrusion, the filaments are quenched and then passed through an appropriate bath or in contact with an applicator where the finish of the present invention may be applied, generally added to water in an amount of from about 1 to about 10 weight percent of the total formulation.

Subsequent to application of finish composition to the filaments, a number of filament tows are combined from a plurality of spin positions and are thereafter processed as a unit. This unit or tow band is passed through a stretch bath after which the two band is stretched, heated, relaxed, restretched and heat set. The heat set filament tow is then cut into staple fiber lengths, ranging generally from about ¼to about 3 inches in length. A filament crimping step may be employed if desired. It is this staple fiber that is later utilized in producing the fiber slurry from which the nonwoven web is manufactured. As mentioned above, the textile finish according to the present invention may be omitted in spinning, however, and may be added to the aqueous medium into which the staple fibers are dispersed to form the fiber slurry. In this embodiment of the present invention, a conventional spin finish may be applied to the filaments to insure good processability, though the conventional spin finish used should not combat the attributes of the dispersing finish in the aqueous medium.

Staple fibers produced according to the above process are added to the aqueous medium in a mixing tank in an amount generally around 0.5 percent by weight of the aqueous medium. The aqueous medium is one normally employed in the production of nonwoven webs and may contain various ingredients other than water so long as there is no physical or chemical interaction between the normal aqueous medium and the present finish composition that would cause excess foaming, deter dispersibility of the individual fibers or diminish fiber bondability in the web. Subsequent to appropriate mixing in the tank, the aqueous fiber slurry is fed to a stock chest where a suitable binder such as an emulsion of an acrylic polymer may be incorporated into the slurry to ultimately bind the discrete fibers across the nonwoven web and thus provide a unitized structure. Alternatively, the chemical binder may be added later. A dispensing roll at the inlet to the stock chest is preferably employed to create microturbulence in the slurry to further foster production of a uniform fiber dispersion. A flow spreader system may be utilized in conjunction with the stock chest to spread the fiber slurry across the desired width of wire of the foaming machine to further assist in providing a uniform placement of fiber completely across the width of a web to be formed. An adjustable Pond regulator is utilized in conjunction with the wire bed of the paper forming machine to define a desired forming area and to control the consistency of fiber slurry during the sheet formation.

The fiber slurry is thus applied onto an endless wire mesh of the forming machine that moves away from the stock chest at approximately the same rate as slurry is applied thereon whereby disruption or scuffing of the sheet is avoided. Suction boxes located beneath the wire mesh withdraw aqueous medium from the slurry whereby a wet unbonded sheet formation remains, constituting a newly formed web. The web is then picked up by a felt transfer mechanism and is carried through a final drying operation. Resins may then be applied to the sheet as desired and are cured. Alternatively, resins may be initially added to the aqueous medium and cured after formation of the web.

As can be readily seen from the above general process steps for the formation of the nonwoven web, a very critical facet of the process is the provision of a proper fiber dispersion or slurry to permit the production of a first quality nonwoven web. This fiber slurry has three basic requisites, all of which are essential to insure the formation of a first quality nonwoven web. The fiber slurry should evidence a uniform appearance of individual fibers. Clumps of fibers that appear in a dispersion will lead to the formation of globs in the final nonwoven web. Additionally, the dispersion should be characterized as not entrapping air during formation of same which means that little or no foaming should be present. Once the slurry is placed on the paper making machine suction applied to remove the aqueous medium also would remove the foam and create voids in the web. Furthermore, to insure the integrity of the nonwoven web produced, the finish applied to the fiber either during fiber production or to the aqueous medium during the preparation of the fiber slurry should not mechanically or chemically interfere with fiber bonding.

To achieve the above requisite qualities, care must be taken to avoid introduction of ingredients into the finish composition that could contribute to the above noted problems. Additionally, the amount of finish added to the fiber should be controlled, for an excess amount of finish results in foaming, and also could potentially create pollution problems should the composition enter streams or rivers via an effluent from the nonwoven web forming area.

The finish composition of the present invention may be added to water as mentioned above, and will form a solution or emulsion, depending upon the ingredients included in the composition. As an essential ingredient to the composition, a primary emulsifier is required that is ethoxylated and contains at least five moles of ethylene oxide. From a practical standpoint the upper range of the number of moles of ethylene oxide included would be determined for the particular emulsifier below a point where good dispersion of the fiber does not result, too much foaming is present, or the like. Examples of suitable primary emulsifiers include, without limitation, POE(30) sorbitol laurate-oleate, POE(50) sorbitol hexoleate, POE(10) castor oil, POE(16) castor oil, POE(20) castor oil, POE(25) castor oil, POE(39) castor oil, POE(40) sorbitol septoleate, ethoxylated hydrogenated castor oils, ethoxylated coconut oil, and ethoxylated sorbitol esters in general. Additionally, mixtures of the primary emulsifiers may be likewise employed so long as the mixture meets the stated requirements for same. In addition to the requisites for the presence of moles of ethylene oxide, the primary emulsifier should also exhibit a surface tension of at lest 30 dynes per centimeter when measured as 0.10 percent solution in distilled water at 25 degrees Centigrade plus or minus 2 degrees Centigrade on a Fisher surface tensiometer, Model 20.

A further potential ingredient for the finish composition according to the presnt invention is a lubricant, the main purpose of which is to improve processability of the fiber during manufacture, and specifically to insure better cutting of the filaments to provide staple length fibers in such a form that coagulated fiber bundles do not remain during dispersing of the fibers, due to physical attachment of adjacent fibers caused by improper cutting. The particular lubricant employed is not critical except from a qualitative standpoint wherein it must be compatible with the primary emulsifier and the overall finish composition to the point where foaming is not enhanced, coagulation of the fibers is not fostered, dispersibility of the individual fibers is not deterred, and bondability of the fibers is not adversely affected. Known suitable lubricants include, without limitation, pentaerythritol tetrapelargonate, coconut oil, mineral oil, butyl stearate, tridecyl stearate, ethoxylated lauryl alcohol, ethoxylated lauric acid, and n-octyl, n-decyl adipate.

In those situations where a lubricant is utilized in the finish compositions of the present invention, a secondary emulsifier is also generally present in an amount of up to 25 percent by weight of the composition. A main purpose of the secondary emulsifier is to emulsify the lubricant per se, though in certain circumstances the secondary emulsifier also assists in dispersion of the fibers in conjunction with the primary emulsifier. The secondary emulsifier, like the lubricant should be compatible with the primary emulsifier to provide a suitable fiber dispersion without excess foaming and without affecting the bondability of the fibers. Suitable secondary emulsifiers include, without limitation, ethylene-propyleneoxide copolymers, ethoxylated straight chain alcohols such as POE(3) $C_{12}$-$C_{18}$ alcohols, ethoxylated nonylphenol such as POE(10.2) nonylphenol, ethoxylated sorbitol esters such as POE(40) sorbitol septoleate, POE(50) sorbitol hexoleate, and POE(30) sorbitol laurate-oleate, low ethoxylates of castor oil such as POE(5) castor oil, and ethoxylated sorbitan esters such as POE(4) sorbitan monostearate.

Certain amounts of other ingredients may also be added to the present finish composition, so long as the stated qualities for the composition are not materially altered, such as anionic constituents for further improved results. Normally the suitable anionic ingredients are surface active agents and are generally esters, preferably esters of phosphates, phosphonates, sulfates, or sulfonates, and most preferably the esters are ethoxylated. Exemplary of suitable anionic candidates are sodium lauryl sulfate, potassium oleate, the potassium salt of butyl carbitol phosphate, a blend of sulfonated glyceryl trioleate-peanut oil, the potassium salt of 2-ethyl hexyl phosphate, 2-ethyl hexyl sulfosuccinate, sodium tallow sarcosine, the potassium salt of POE(6) decyl alcohol phosphate, potassium octyl phosphonate, the potassium salt of POE(7) $C_{13-15}$ alcohol phosphate, sulfonated peanut oil, the potassium salt of dilauryl phosphate and sulfonated castor oil. Generally any anionic surfactant may be added to the finish composition of the present invention for improved dispersibility and resulting web formation, presumably due to interaction with other of the ingredients of the finish composition though this hypothesis should not be considered to be binding. For direct addition to the dispersion, certain anionic surfactants may be added either in conjunction with or in lieu of other ingredients, of the non-woven manufacturer's white water formulation, for example, the alkylaryl polyether alcohols of Ring et al mentioned above, with similar results. These particular surfactants generally fall into a class made up of ethoxylated alcohol phosphate esters and alcohol esters of phosphates, phosphonates, sulfates, and sulfonates having a chain length of at least about 12 carbon atoms, with both members of the class exhibiting a surface tension of at least 30 dynes per centimeter as defined herein. When added directly to the dispersing medium, the particular anionic surfactant should be added in an amount adequate to properly disperse the fibers. Generally total surfactant addition to the white water for initial dispersion falls in the range of from about 0.007 to about 0.03 percent based on the weight of the water.

In those compositions according to the present invention which includes a primary emulsifier, lubricant and secondary emulsifier, the three ingredients should be present according to a preferred embodiment in the following ranges: primary emulsifier at least 40 percent by weight; lubricant 25 to 50 percent by weight and secondary emulsifier 0 to 25 percent by weight. Likewise, the combination of lubricant and secondary emulsifier should not exceed the amount of primary emulsifier nor should the amount of secondary emulsifier exceed the amount of lubricant.

In applying the finish composition of the present invention onto the fiber or adding same to the aqueous medium to provide a suitable fiber dispersion, the composition should be added in an amount approximating at least about 0.1 percent based on fiber weight. A preferred range of add on for the finishing composition is in the range of about 0.4 to about 0.6 by weight of the fiber. While the generally preferred ranges have been set forth, the amount of the finishing composition that is added to the fiber or bath may vary practically for a particular composition with a general upper limit being determined by the degree of foaming and pollution problems. In general for application onto the fiber, the finish composition may be added to water to form a formulation having a concentration of from about one to about 10 weight percent finish composition.

While any amount of anionic ingredient in the finish formulation will result in improvement, anionic constituents in the finish composition as present on the fiber generally fall into a range of from about 5 to about 20 weight percent based on the weight of the oil phase of the composition, preferably about 15 weight percent. When added directly to the dispersing medium, the anionic surfactant should be present in an amount of at least about 0.0005 weight per cent of the medium, though preferably as set forth above, in a range of from about 0.007 to about 0.03 weight percent.

In determining suitability of particular ingredients for use as primary emulsifiers in the finish composition of the present invention, aqueous formulations were produced from the ingredients listed in Table I. Each formulation was tested for foaming, dispersibility and surface tension. The amount of finish ingredient on the fiber was determined.

For the fiber dispersibility test as reported in Tables I and II, a Plexiglas cell having inside measurements of 10 inches high by 10 inches wide by three inches thick was utilized. Three liters of water at 25 degrees Centigrade was placed in the Plexiglas cell after which a 1.5 gram sample of short cut staple fibers with finish composition thereon was placed into the water. Once the fibers wet out and reached the bottom of the cell, a glass stirring rod was inserted and twenty-five passes were made from across the cell, at a rate of one stroke per second to disperse the fibers into the water. After one minute, the dispersion was then observed and visually rated. The visual observations and ratings of fiber dispersions were based on the evenness of fibers across the test cell and observations of any fiber clumps. Foaming was rated by placing formulations into a beaker and placing the beaker on a magnetic stir plate. Stirring with a good vortex continued for approximately two to three minutes after which the degree of foaming was visually rated.

In determining surface tension for the various samples, a 0.10 percent by weight aqueous formulation was produced from the particular ingredient or finish composition and distilled water at 25 degrees Centigrade plus or minus two degrees Centigrade. The material was then tested on a Fisher surface tensiometer, Model 20 and surface tension data recorded.

The present invention may be better understood by reference to the following examples.

EXAMPLES 1 to 15

Particular ingredients thought to be potential candidates for use as primary emulsifiers in the finish composition of the present invention were tested as described above for fiber dispersion, surface tension and foaming propensity. These ingredients are listed in Table I where the data from the various tests are reported.

rate exhibited only a fair fiber dispersion. In addition to the ingredients listed in Table I, an untreated fiber was placed in the test cell and immediately stirred according to the test procedure to determine dispersion. The untreated fiber did not disperse across the cell and secondly, evidenced substantial fiber clumps. A further testing of the untreated fiber was made with stirring according to the test procedure occurring fiber a one hour wetting time. The fiber dispersion after the one hour wetting time was better than the immediate dispersion, but continued to show the presence of substantial fiber clumps.

Table I thus illustrates certain of the primary emulsifiers that would be suitable for use per se in the finish composition for addition to the staple fibers generally in a water formulation or addition per se to the aqueous medium in which the staple fibers are to be dispersed. As mentioned hereinbefore, however, a lubricant and a secondary emulsifier are likewise desirable in certain circumstances to improve processability of the fiber during production of same.

TABLE I

EVALUATON OF POTENTIAL PRIMARY EMULSIFIERS

| EXAMPLE NO. | INDIVIDUAL INGREDIENT | FIBER DISPERSION | Surface TENSION dynes/cm. | FINISH ADD ON, % owf. | FOAMING[1] |
|---|---|---|---|---|---|
| 1 | POE(16) castor oil | GOOD | 38.7 | 1.42 | – |
| 2 | POE(5) castor oil | POOR | 35.2 | 0.73 | – |
| 3 | POE(10) castor oil | GOOD | 40.4 | 0.82 | – |
| 4 | POE(50) sorbitol hexoleate | FAIR-GOOD | 38.7 | 0.50 | o |
| 5 | POE(25) castor oil | GOOD | 41.6 | 0.98 | o+ |
| 6 | POE(10.2) nonylphenol | FAIR-POOR | 30.2 | 0.71 | + |
| 7 | POE(39) castor oil | GOOD | 40.5 | 0.56 | + |
| 8 | POE(4) sorbitan monolaurate | FAIR-POOR | 32.6 | 0.64 | o |
| 9 | POE(10) di(1,4 butylene glycol) | POOR | 58.2 | 0.68 | + |
| 10 | POE(9) $C_{11}$ linear alcohol | POOR | 29.5 | 0.77 | o |
| 11 | POE(4) sorbitan monostearate | FAIR-POOR | 39.4 | 1.12 | o |
| 12 | POE(20) coconut oil | GOOD | 37.5 | 0.75 | o |
| 13 | POE(10) coconut oil | GOOD | 33.1 | 0.69 | – |
| 14 | Polybutylene glycol 500 | POOR | 43.8 | 0.69 | – |
| 15 | POE(5) hydrogenated castor oil | GOOD | | | |

[1]Foaming rating: – = little, if any foaming; o = small amount of foaming; + = excess foaming From Table I it can be observed that certain of the ingredients are acceptable while others appear to be unacceptable. Note for instance, Example 2 where a poor fiber dispersion resulted from the use of POE(5) castor oil; Example 6, wherein POE(10.2) nonylphenol demonstrated a fair to poor fiber dispersion and excessive foaming; Example 9, wherein POE(10) di(1,4 butylene glycol) demonstrated a poor fiber dispersion and exhibited excessive foaming; Example 10, wherein POE(9) $C_{11}$ linear alcohol demonstrated a poor dispersion, and Example 11, wherein POE(4) sorbitan monostea- EXAMPLES 16 to 36

In like fashion to the individual ingredients set forth above, compositions including (a) a primary emulsifier, (b) a lubricant, and (c) a secondary emulsifier were tested for fiber dispersion, surface tension, and foaming. The test procedures as described prior to Table I likewise apply for these Examples 16 to 36. A standard primary emulsifier, POE(16) castor oil was utilized and either the lubricant or the secondary emulsifier was varied. Data are reported in Table II.

TABLE II

SHORT CUT FIBER FINISH COMPOSITION EVALUATION

| EXAMPLE NO. | COMPOSITION | FIBER DISPERSION | SURFACE TENSION dynes/cm. | FINISH ADD ON, % owf. | FOAMING[1] |
|---|---|---|---|---|---|
| 16 | (a) 50 pts. POE(16) castor oil<br>(b) 25 pts. Pentaerythritol tetrapelargonate<br>(c) 25 pts. POE(50) sorbitol hexoleate | GOOD | 40.0 | 0.97 | – |
| 17 | (a) 50 pts. POE(16) castor oil<br>(b) 25 pts. POE(50) sorbitol hexoleate<br>(c) 25 pts. POE(20) coconut oil | GOOD | 38.0 | 1.02 | o |
| 18 | (a) 50 pts. POE(16) castor oil<br>(b) 25 pts. POE(50) sorbitol hexoleate<br>(c) 25 pts. 70 SUS visc. mineral oil | GOOD | 39.5 | 3.82 | – |
| 19 | (a) 50 pts. POE(16) castor oil<br>(b) 25 pts. POE(50) sorbitol hexoleate<br>(c) 25 pts. butyl stearate | FAIR | 40.2 | 0.91 | – |

TABLE II-continued

SHORT CUT FIBER FINISH COMPOSITION EVALUATION

| EXAMPLE NO. | COMPOSITION | FIBER DISPERSION | SURFACE TENSION dynes/cm. | FINISH ADD ON, % owf. | FOAMING[1] |
|---|---|---|---|---|---|
| 20 | (a) 50 pts. POE(16) castor oil | | | | |
| | (b) 25 pts. POE(50) sorbitol hexoleate | | | | |
| | (c) 25 pts. tridecylstearate | FAIR | 39.5 | 0.82 | – |
| 21 | (a) 50 pts. POE(16) castor oil | | | | |
| | (b) 25 pts. POE(50) sorbitol hexoleate | | | | |
| | (c) 25 pts. POE(4) lauryl alcohol | FAIR | 33.5 | 0.95 | – |
| 22 | (a) 50 pts. POE(16) castor oil | | | | |
| | (b) 25 pts. POE(50) sorbitol hexoleate | | | | |
| | (c) 25 pts. POE(12) lauric acid | FAIR | 37.5 | 0.80 | o |
| 23 | (a) 50 pts. POE(16) castor oil | | | | |
| | (b) | 25 pts. n-octyl, n-decyl adipate | | | |
| | (c) 25 pts. ethylene-propylene oxide (EO 10) copolymer mol. wt. 2750 | FAIR | 39.1 | 0.85 | o |
| 24 | (a) 50 pts. POE(16) castor oil | | | | |
| | (b) | 25 pts. n-octyl, n-decyl adipate | | | |
| | (c) 25 pts. POE(4) lauryl alcohol | GOOD | 33.1 | 0.71 | o |
| 25 | (a) 50 pts. POE(16) castor oil | | | | |
| | (b) 25 pts. n-octyl, n-decyl adipate | | | | |
| | (c) 25 pts. POE(12) lauric acid | FAIR | 39.5 | 0.85 | o |
| 26 | (a) 50 pts. POE(16) castor oil | | | | |
| | (b) 25 pts. n-octyl, n-decyl adipate | | | | |
| | (c) 25 pts. POE(3) $C_{12-18}$ alcohols | GOOD | 34.6 | 0.52 | – |
| 27 | (a) 50 pts. POE(16) castor oil | | | | |
| | (b) 25 pts. n-octyl, n-decyl adipate | | | | |
| | (c) 25 pts. POE(10.2) nonylphenol | GOOD | 38.1 | 0.68 | o |
| 28 | (a) 50 pts. POE(16) castor oil | | | | |
| | (b) 25 pts. n-octyl, n-decyl adipate | | | | |
| | (c) 25 pts. POE(40) sorbitol septoleate | GOOD | 44.8 | 0.83 | o |
| 29 | (a) 50 pts. POE(16) castor oil | | | | |
| | (b) 25 pts. n-octyl, n-decyl adipate | | | | |
| | (c) 25 pts. POE(30) sorbitol laurate | FAIR | 41.4 | 0.55 | o |
| 30 | (a) 50 pts. POE(16) castor oil | | | | |
| | (b) 25 pts. n-octyl, n-decyl adipate | | | | |
| | (c) 25 pts. POE(4) sorbitan monostearate | GOOD | 40.1 | 1.69 | – |
| 31 | (a) 50 pts. POE(16) castor oil | | | | |
| | (b) 25 pts. n-octyl, n-decyl adipate | | | | |
| | (c) 25 pts. POE(4) sorbitan monolaurate | GOOD–FAIR | 40.1 | 0.82 | – |
| 32 | (a) 50 pts. POE(16) castor oil | | | | |
| | (b) 25 pts. n-octyl, n-decyl adipate | | | | |
| | (c) 25 pts. POE(10) coconut oil | FAIR–POOR | 37.3 | 0.72 | o |
| 33 | (a) 50 pts. POE(16) castor oil | | | | |
| | (b) 25 pts. POE(4) sorbitan monolaurate | | | | |
| | (c) 25 pts. POE(50) sorbitol hexoleate | GOOD | 38.3 | 0.68 | – |
| 34 | (a) 50 pts. POE(16) castor oil | | | | |
| | (b) 25 pts. POE(50) sorbitol hexoleate | | | | |
| | (c) 25 pts. POE(10) coconut oil | GOOD | 44.0 | 0.88 | o |
| 35 | (a) 50 pts. POE(10) castor oil | | | | |
| | (b) 50 pts. POE(20) castor oil | GOOD | | | – |
| 36 | (a) 50 pts. POE(16) castor oil | | | | |
| | (b) 25 pts. n-octyl, n-decyl adipate | | | | |
| | (c) 25 pts. POE(50) sorbitol hexoleate | GOOD | 40.9 | 0.55 | – |

[1]Foaming rating: – = little, if any foaming; o = small amount of foaming; + = excess foaming Note in Examples 16 to 36 all of the dispersions were rated at least fair, and would be acceptable according to the broad teachings of the present invention. This is based primarily on the use of a known acceptable primary emulsifier, and these examples are provided to further illustrate compatibility of lubricant and secondary emulsifier with the primary emulsifier. Certain of the ingredients that were individually tested in Examples 1 to 15 and proved unacceptable, are demonstrated to be suitable in combination with other ingredients. Note for example, the use of the POE(10.2) nonylphenol of Example 6 which rated only fair to poor in the dispersion and showed a surface tension of 30.2, barely above the lower limit of surface tension. When 25 parts by weight were added, however, to 50 parts by weight of POE(16) castor oil and 25 parts by weight of n-octyl, n-decyl adipate lubricant, a good dispersion was noted along with a surface tension for the composition of 38.1 dynes per centimeter.

EXAMPLES 37 to 40

The individual ingredients of Examples 2, 6, 9 and 10 were substituted for the POE(16) castor oil of Example 36 and fiber dispersion tests were again run. In each of these Examples, a poor or poor to fair fiber dispersion resulted.

EXAMPLES 41 to 56

A 1.5 denier per filament polyester fiber was treated with various concentrations of formulation with the finish composition of Example 36. A ten gram fiber sample was placed into a container with the various concentration finish formulations. After the fibers had wet out, the fibers were removed from the container and placed in a hose leg. The hose leg having the wet fibers therein was centrifuged for one minute, and thereafter the fiber was allowed to dry overnight. The following day, methanol extractions were conducted on the various fiber samples to determine the amount of finish pickup. These data are reported in Table III. Though some inconsistency appears to be present, the reported data do appear to represent a relationship between concentration of oil phase in the emulsion, and fiber finish add on, and dispersion quality.

TABLE III

| FIBER PICKUP OF FINISH COMPOSITIONS | | | |
|---|---|---|---|
| EXAMPLE NO. | FINISH CONCENTRATION, % | FINISH ON FIBER, wt. % | FIBER DISPERSION |
| 41 | 0.008 | 0.13 | FAIR |
| 42 | 0.02 | 0.12 | " |
| 43 | 0.04 | 0.15 | " |
| 44 | 0.06 | 0.17 | " |
| 45 | 0.08 | 0.16 | GOOD |
| 46 | 0.2 | 0.23 | " |
| 47 | 0.4 | 0.34 | " |
| 48 | 0.6 | 0.37 | " |
| 49 | 0.8 | 0.46 | " |
| 50 | 1.0 | 0.22 | " |
| 51 | 2.0 | 0.45 | " |
| 52 | 3.0 | 0.55 | " |
| 53 | 4.0 | 0.70 | " |
| 54 | 5.0 | 0.89 | " |
| 55 | 6.0 | 1.02 | " |
| 56 | 7.0 | 0.72 | " |

EXAMPLE 57

Plant trials were conducted wherein 1.5 denier per filament polyester filament was extruded, quenched and treated with a 3.0 weight percent finish formulation of composition of Example 36 in water. Thereafter, the fiber was processed as described above and cut into ¼ and ¾ inch staple fiber lengths. The staple fibers with the finish thereon was then placed in an aqueous medium in a mixing tank for a wet lay nonwoven process and nonwoven web was produced therefrom according to the general process steps set forth hereinabove. Little foaming was evident throughout the wet lay process and highly suitable nonwoven webs were produced.

EXAMPLE 58

A further plant trial was run as described in Example 57 with the exception that the finish composition included 42.6 weight percent POE(16) castor oil, 21.2 weight percent POE(50) sorbitol hexoleate, 21.2 weight percent n-octyl, n-decyl adipate and 15 weight percent potassium hexyl phosphate. An excellent fiber dispersion resulted and a quality nonwoven web was produced.

One further technique for determining suitability of ingredients for finishes, dispersion, etc. for a wet lay nonwoven process is the use of the ingredient in the formation of a fiber sheet in a hand sheet mold. Procedure followed in the production of hand sheets for the following examples is set forth below. Forty ounces of water was placed in a blender along with 10 drops (d) of the ingredients bein tes ted, unless otherwise specified. With the blender operating, 0.8 gram of fiber was added and blending continued for one minute. Contents of the blender were then poured into the hand sheet mold which was half filled with water, after which further water was added to fill the mold. The agitator was moved up and down for eight strokes, and the water was immediately drained off. The sheet was then pressed out using a roller and a paper towel to provide the formed sheet, and the sheet was allowed to air dry.

After formation of the sheet, the sheet was visually rated based on voids in the sheet, presence of fiber clumps, and evenness of fiber across the sheet, taking into consideration that the edges of the circular sheet are subject to damage during removal from the mold.

EXAMPLES 59–71

Fiber dispersions were produced as described immediately above, utilizing the particular ingredients as identified in Table IV, after which sheets were formed in the hand sheet mold. Ratings of the various sheets are noted in Table IV. For certain of the dispersions, all finish was extracted from the fiber prior to preparing the dispersion, while for others, fiber with specified finish thereon was utilized. Sheets ratings are poor (P), fair (F), good (G), very good (VG) adn excellent (E).

TABLE IV

| PREPARATION AND RATING OF HAND SHEET MOLD SHEETS | | | |
|---|---|---|---|
| Example No. | Ingredients on Fiber | Added to Medium | Sheet Rating |
| 59 | — | — | F–P |
| 60 | Finish per Example 36 | — | G |
| 61 | Finish per Example 58 | — | G |
| 62 | — | Finish per Example 36 | G |
| 63 | — | Finish per Example 58 | G |
| 64 | — | 0.25% Separan | F |
| 65 | — | Triton X-114 | VG |
| 66 | Finish of Example 36 | 0.25% Separan | P |
| 67 | " | Triton X-114 | VG |
| 68 | " | 0.25% Separan, 10d Triton X-114 10d | E |
| 69 | — | " (5d each) | G |
| 70 | — | " (10d each) | VG–E |
| 71 | Finish of Example 36 | " (5d each) | VG |

As can be seen from Examples 59–71 in Table IV, best results of the ingredients tested appear to be attained where a finish of the present invention is present on the fiber and ingredients according to the Ring et al patent, U.S. Pat. No. 4,007,803, are added to the dispersing medium. Such Examples do not include anionic ingredients. Triton K-114 is an alkylaryl polyether alcohol type wetting agent (octyl-phenol series), manufactured by Rohm & Hass, Philadelphia, Pa., while Separan is a polyacrylamide thickener manufactured by Dow Chemical Corporation, Midland, Michigan.

EXAMPLES 72–84

Further mold sheets were produced as described above using extracted fiber and adding the named ingredients to the dispersing medium in conjunction with or in lieu of Triton X-114 material. Materials, amounts and visual sheet ratings are set forth in Table V. For each of the Examples 72–84, (a) represents addition of the anionic ingredient only to the medium; (b) represents the addition of a formulation made up of 50 parts of POE(16) castor oil, 25 parts of POE(50) sorbitol hexoleate and 15 parts of the specified anionic ingredient; and (c) represents the addition of 5 drops of the formulation of (b), 5 drops of Separan and 5 drops of Triton X-114.

TABLE V

Evaluation of Anionics in Production of Sheet Molds

| Example No. | Anionic in Medium | Sheet Rating |
|---|---|---|
| 72 | Sulfonated Peanut Oil | |
| | | (a) F |
| | | (b) F |
| | | (c) G–VG |
| 73 | The Potassium Salt of Dilauryl Phosphate | |
| | | (a) F |
| | | (b) F |
| | | (c) G–E |
| 74 | Sulfonated Castor Oil | |
| | | (a) P |
| | | (b) F |
| | | (c) G–E |
| 75 | Sodium Lauryl Sulfate | |
| | | (a) G |
| | | (b) G |
| | | (c) G–E |
| 76 | Potassium Oleate | |
| | | (a) P |
| | | (b) G |
| | | (c) VG |
| 77 | The Potassium Salt of Butyl Carbitol Phosphate | |
| | | (a) F |
| | | (b) G |
| | | (c) VG |
| 78 | Sulfonated Glycerol Trioleate/Peanut Oil Blend | |
| | | (a) F |
| | | (b) G |
| | | (c) VG |
| 79 | The Potassium Salt of 2-Ethyl Hexyl Phosphate | |
| | | (a) P |
| | | (b) G |
| | | (c) VG |
| 80 | 2-Ethyl Hexyl Sulfosuccinate | |
| | | (a) G |
| | | (b) G |
| | | (c) E |
| 81 | Sodium Tallow Sarcosine | |
| | | (a) F |
| | | (b) F |
| | | (c) G |
| 82 | The Potassium Salt of POE(6) Decyl Alcohol Phosphate | |
| | | (a) VG |
| | | (b) VG |
| | | (c) E |
| 83 | Potassium Octyl Phosphonate | |
| | | (a) P |
| | | (b) G |
| | | (c) VG |
| 84 | The Potassium Salt of POE(7) $C_{13-15}$ | |

TABLE V-continued

Evaluation of Anionics in Production of Sheet Molds

| Example No. | Anionic in Medium | Sheet Rating |
|---|---|---|
| | Alcohol Phosphate | |
| | | (a) VG |
| | | (b) F |
| | | (c) G |

As can be seen from the Examples reported in Table V, certain of the anionic compounds perform unsatisfactorily alone while satisfactorily in conjunction with the finish competition, or in the presence of the Triton X-114. Likewise certain of the anionics performed very excellently, even alone, indicating that they may be substituted in the dispersing medium for the Triton type compound. In order to equate the suitability of the various anionics, characteristics of the compounds were considered to determine the parameters of same that appear to lead to formation of a good mold sheet.

Among the parameters checked were ethoxylation, chain length, and surface tension. As can be seen from Table V, those compounds that are ethoxylated appear to form desirable mold sheets without regard to chain length. With the anionics that are not ethoxylated, chain length becomes more important, and it was determined that at least about 12 carbon atoms should be in the chain. With ethoxylated anionics and nonethoxylated anionics having an appropriate chain length, surface tension of the compound in a solution as identified hereinbefore, continues to remain important. Solutions were made up for certain of the anionics that produced acceptable mold sheets and for certain that did not produce acceptable sheet molds. Surface tension measurements were then made at 25 degrees Centigrade plus or minus two degrees Centigrade, as defined hereinbefore. Results are set forth in Table VI.

TABLE VI

Surface Tension Measurements for Anionic Compounds

| Compound | Moles E.O. | Carbon Chain Length | Surface Tension, dyne/cms. | Model Sheet Rating |
|---|---|---|---|---|
| Potassium hexyl Phosphate | 0 | 6 | 37.7 | P |
| 2 ethyl hexyl sulfosuccinate | 0 | 12 | 30.3 | G |
| Potassium Octyl Phosphonate | 0 | 8 | 30.2 | P |
| Sodium Lauryl Sulfate | 0 | 12 | 32.3 | G |
| Potassium Oleate | 0 | 18 | 26.5 | P |
| Sodium tallow Sarcosine | 0 | 19 | 30.2 | G |
| Sulfonated Castor Oil | 0 | 18 | 41.7 | G |
| Potassium Dilauryl Phosphate | 0 | 24 | 30.3 | G |
| Sulfonated Peanut Oil | 0 | >12 | 40.4 | F–G |
| Sulfonated Glyceryl Trioleate/Peanut Oil | 0 | >12 | 38.5 | F–G |
| Potassium butyl Carbitol Phosphate | 2 | 8 | 55.0 | F–G |
| Potassium POE(6) Decyl Alcohol Phosphate | 6 | 22 | 32.6 | G |
| Potassium POE(3) $C_{15-17}$ Alcohol Phosphate | 3 | 22 | 38.8 | G |

As can thus be seen from Table VI, those anionic surfactants as qualified above perform within acceptable ranges even when employed alone in the dispersing medium.

Having described the present invention in detail, it is obvious that one skilled in the art will be able to make variations and modifications thereto without departing from the scope of the invention. Accordingly, the scope of the present invention should be determined only by the claims appended hereto.

That which is claimed is:

1. A method of preparing a stable aqueous dispersion of synthetic polymeric staple fibers comprising the steps of:

(a) placing a quantity of staple fibers in an aqueous medium;

(b) introducing into said aqueous medium a composition in an amount equivalent to at least 0.1 percent based on the weight of the fibers present in the medium, said composition being characterized as promoting dispersion of said fibers, as having a low foaming propensity and not adversely affecting bondability of said fibers in the presence of a chemical binder therefor, said composition comprising a primary emulsifier selected from the group consisting of ethoxylated castor oils, ethoxylated hydrogenated castor oils, ethoxylated coconut oil, ethoxylated sorbitol esters and mixtures of same, a lubricant for the fibers and a secondary emulsifier, said lubricant and said secondary emulsifier being compatible with said primary emulsifier, said composition being present on the fibers and exhibiting a surface tension of at least 30 dynes per centimeter in a 0.10 weight percent solution of same at about 25 degrees Centigrade; and (c) producing agitation in said aqueous medium whereby individual fibers disperse throughout said medium without excess foaming.

2. The method as defined in claim 1 wherein the lubricant is a member selected from the group consisting of pentaerythritol tetrapelargonate, ethoxylated coconut oil, mineral oil, and n-octyl, n-decyl adipate.

3. The method as defined in claim 2 wherein the secondary emulsifier is POE(50) sorbitol hexoleate.

4. A method of preparing a stable aqueous dispersion of synthetic polymeric staple fibers comprising the steps of:

(a) placing a quantity of staple fibers in an aqueous medium;

(b) introducing into said aqueous medium a composition in an amount equivalent to at least 0.1 percent based on the weight of the fibers present in the medium, said composition being characterized as promoting dispersion of said fibers, as having a low foaming propensity and not adversely affecting bondability of said fibers in the presence of a chemical binder thereof, said composition being present on the fibers and comprising a primary emulsifier, a lubricant for the fibers and a secondary emulsifier, said lubricant and said secondary emulsifier being compatible with said primary emulsifier, and wherein said primary emulsifier is POE(16) castor oil, the lubricant is n-octyl, n-decyl adipate and the secondary emulsifier is POE (50) sorbitol hexoleate, said composition further containing potassium hexyl phosphate; and (c) producing agitation in said aqueous medium whereby individual fibers disperse throughout said medium without excess foaming.

5. A method of preparing a stable aqueous dispersion of synthetic polymeric staple fibers comprising the steps of:

(a) placing a quantity of staple fibers having a length of from about ¼ to about 3 inches in an aqueous medium;

(b) introducing into said aqueous medium ingredients in an amount equivalent to at least 0.1 percent based on the weight of fibers present in the medium, said ingredients cooperating to promote dispersion of said fibers, cooperatively having a low foaming propensity, and not affecting fiber bondability in the presence of a chemical binder therefor, said ingredients including a primary emulsifier that contains at least five moles of ethylene oxide and exhibits a surface tension of at least 30 dynes per centimeter in a 0.10 weight percent solution of same at about 25 degrees Centigrade, a wetting agent for wetting out said fibers, said wetting agent having a surface tension in a range of from about 35 to about 40 dynes per centimeter, a thickening agent and an anionic surfactant, said anionic surfactant being added directly to the aqueous medium and being selected from the group consisting of ethoxylated anionics and alcohol esters of phosphates, phosphonates, sulfates, and sulfonates having a chain length of at least about 12 carbon atoms, and with members of both groups exhibiting a surface tension of at least about 30 dynes per centimeter in a 0.10 weight percent aqueous solution of same at about 25 degrees Centigrade; and (c) providing agitation for said aqueous medium whereby individual fibers become dispersed therein without excess foaming.

* * * * *